United States Patent [19]

Stahlecker et al.

[11] Patent Number: 4,773,211

[45] Date of Patent: Sep. 27, 1988

[54] ARRANGEMENT FOR OPEN-END SPINNING

[75] Inventors: Fritz Stahlecker, Josef-Neidhart-Strasse 18, 7347 Bad Überkingen; Hans Raasch; Heinz-Georg Wassenhoven, both of Mönchengladbach, all of Fed. Rep. of Germany

[73] Assignees: W. Schlafhorst & Co.; Hans Stahlecker; Fritz Stahlecker, all of Fed. Rep. of Germany

[21] Appl. No.: 27,243

[22] Filed: Mar. 18, 1987

[30] Foreign Application Priority Data

Mar. 19, 1986 [DE] Fed. Rep. of Germany ..... 3609114

[51] Int. Cl.[4] ..... D01H 7/882; D01H 1/135; D02G 1/04

[52] U.S. Cl. ..... 57/417; 57/334; 57/352; 57/414

[58] Field of Search ..... 57/404, 414, 417, 352, 57/334

[56] References Cited

U.S. PATENT DOCUMENTS

| | | | |
|---|---|---|---|
| 3,523,300 | 8/1970 | Tabata et al. | 57/417 X |
| 3,640,061 | 2/1972 | Landwehrkamp | 57/417 |
| 3,789,597 | 2/1974 | Schon | 57/417 |
| 3,861,131 | 1/1975 | LeChatelier | 57/417 |
| 3,875,731 | 4/1975 | Khomyakov et al. | 57/417 |
| 3,903,683 | 9/1975 | Shino | 57/417 |
| 4,258,541 | 3/1981 | LeChatelier et al. | 57/417 |
| 4,481,766 | 11/1984 | Kurushima et al. | 57/417 |
| 4,499,719 | 2/1985 | Faessler | 57/417 |
| 4,516,397 | 5/1985 | Raasch et al. | 57/415 X |

FOREIGN PATENT DOCUMENTS

| | | |
|---|---|---|
| 2702733 | 7/1977 | Fed. Rep. of Germany . |
| 3332498 | 3/1984 | Fed. Rep. of Germany . |
| 1569123 | 6/1980 | United Kingdom . |

*Primary Examiner*—John Petrakes
*Attorney, Agent, or Firm*—Barnes & Thornburg

[57] ABSTRACT

An apparatus for open-end spinning is provided which includes a twisting element for twisting yarn. A yarn withdrawal nozzle is provided downstream from the twisting device in a yarn withdrawal direction. A yarn withdrawal device downstream from the yarn withdrawal nozzle withdraws yarn from the twisting device. A yarn deflection device is provided for deflecting yarn downstream from the yarn withdrawal nozzle. The yarn deflection device includes at least one false-twisting edge. The yarn deflection device includes a first deflection which deflects the yarn in a first direction and at least one additional deflection downstream from the first deflection which deflects the yarn into a direction deviating from the first direction.

37 Claims, 2 Drawing Sheets

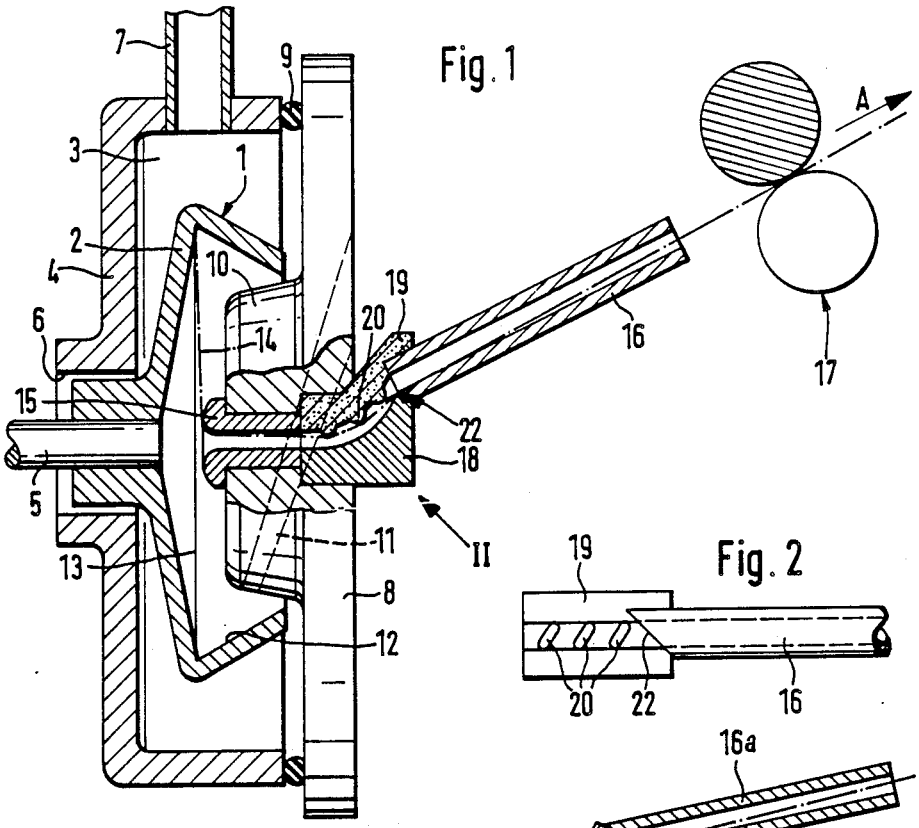
Fig. 1
Fig. 2
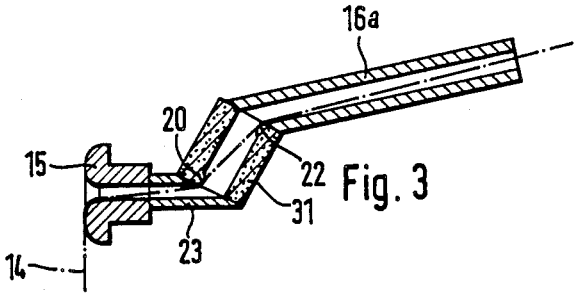
Fig. 3
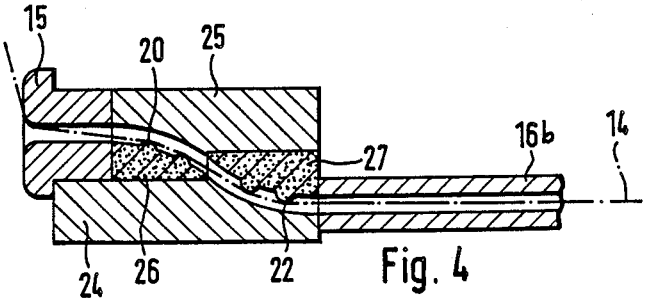
Fig. 4

ARRANGEMENT FOR OPEN-END SPINNING

BACKGROUND AND SUMMARY OF THE INVENTION

The invention relates to an arrangement for open-end spinning having a twisting element, a yarn withdrawal nozzle, a yarn withdrawal device and a deflection arranged behind the yarn withdrawal nozzle in yarn withdrawal direction. The deflection has at least one false-twisting edge.

In the case of open-end spinning and particularly in the case of open-end rotor spinning in which a spinning rotor is used as the twisting element, the problem arises that the true yarn twist does not completely enter into the forming yarn. In the case of open-end rotor spinning, the true twist is applied essentially between a yarn withdrawal nozzle and a yarn withdrawal device that enters into the yarn piece partially upstream from the withdrawal nozzle, i.e., into the yarn piece extending from the yarn withdrawal nozzle to the rotor groove. Under certain circumstances, this yarn piece may therefore have less twist than normal yarn so that the spinning stability suffers, particularly when a yarn with a low twist is to be spun. In practice, the yarn withdrawal nozzles are usually provided with a surface structure so that due to the friction of the yarn at the yarn withdrawal nozzle, an increased false twist is to be generated such that the twist is increased in the yarn section between the yarn withdrawal nozzle and the rotor groove.

In order to introduce the true yarn twist into the yarn section located upstream from the yarn withdrawal nozzle to a more extensive degree, it is known (DE-OS No. 33 32 498) to arrange a deflection having at least one false-twisting edge in the area behind the withdrawal nozzle. This deflection has an inclination directed toward the moving direction of the yarn that extends approximately in the same direction as the inclination of the twist of the yarn resting against this false twisting edge. By this measure, an improved introduction of twist into the yarn section located in front of the yarn withdrawal nozzle is made possible.

An object of the invention is to develop an arrangement for a spinning unit such that the introduction of the true yarn twist into the yarn section located in front of the yarn withdrawal nozzle is improved.

This object is achieved by providing a deflection downstream from the yarn withdrawal nozzle in yarn withdrawal direction. Further, an additional deflection is provided that deflects the yarn into a direction that deviates from the direction of the preceding deflection.

By this measure, the effect of the at least one false-twisting edge is increased because the yarn is prevented to a more extensive degree from lifting itself of the at least one false-twisting edge and having the twist "skip over" this false-twisting edge. Further, by this second deflection, the moving path of the yarn is not significantly limited, so that it remains possible to suck a yarn end back into the spinning rotor for the purpose of piecing.

It is known (DE-OS No. 27 02 733) to let the yarn move via two deflecting edges acting in opposite directions, at a distance from a yarn withdrawal nozzle. The deflecting edges are directed transversely to the moving direction and serve the purpose of forming a type of twist block. However, it was found that in practice the effect of deflecting edges of this type, that extend transversely to the yarn moving path, does not result in an improvement of the distribution of the twist.

In further advantageous features of a preferred embodiment of the invention, it is provided that the two deflections are arranged on opposite sides with respect to the yarn. In a particularly advantageous way, it is further provided in this case that the deflection that is located on the outlet side contains at least one false-twisting edge. If the yarn lifts off the at least one first false-twisting edge, the effect of this edge is promoted because the yarn is subjected to the effect of the at least one second false-twisting edge to an increased degree so that the distribution of the twist is maintained.

In further advantageous features of a preferred embodiment of the invention, it is provided that the deflection downstream from the yarn withdrawal nozzle is formed by an insert that is inserted between two sections of a yarn withdrawal channel. In a further advantageous feature, it is also provided that the end of the second section of the yarn withdrawal channel that faces the insert is developed as a deflecting edge and/or a false-twisting edge.

In further advantageous features of a preferred embodiment of the invention, it is provided that a yarn withdrawal channel is connected to the yarn withdrawal nozzle. The yarn withdrawal channel is formed of two sections that are staggered with respect to one another. An insert contains the first and the second deflection and is arranged between the sections. In a further advantageous feature, it is provided that the insert is developed as a sleeve. The end of the sleeve facing the yarn withdrawal nozzle is developed as a false-twisting edge forming the first deflection, and the end facing away is developed as a false-twisting edge forming the second deflection. In this feature, only one insert is used in order to obtain both deflections.

In further advantageous features of a preferred embodiment of the invention, it is provided that a yarn withdrawal channel formed of two sections connects to the yarn withdrawal nozzle. An insert deflecting the yarn is arranged between the sections, and the insert is provided with at least one false-twisting edge. In this embodiment, three deflections are provided, including one at the end of the first section of the yarn withdrawal channel, one in the area of the insert and one at the start of the second section of the yarn withdrawal channel. This embodiment also has the advantage that the moving direction of the yarn is unchanged upstream from and downstream from the deflections. This allows an existing assembly to be modified.

In further advantageous features of a preferred embodiment of the invention, it is provided that a yarn withdrawal channel, that is formed of two sections that are staggered with respect to one another, is connected to the yarn withdrawal nozzle. Between the sections, two inserts are arranged that are provided with false twisting edges. The inserts provide a path of the yarn which is approximately S-shaped. The sections of the yarn withdrawal channel are connected approximately tangentially to the inserts.

In further advantageous features of a preferred embodiment of the invention, it is provided that an insert that forms an approximately sinusoidally shaped channel, is connected to the yarn withdrawal nozzle. Also, the insert is provided with at least one false-twisting edge in the area of the turning points. In this embodiment, it is advantageously provided that the insert includes two parts that form the channel between them.

Other objects, advantages and novel features of the present invention will become apparent from the following detailed description of the invention when considered in conjunction with the accompanying drawings.

BRIEF DESCRIPTION OF THE DRAWINGS

FIG. 1 is a partial sectional view of an open-end rotor spinning arrangement in the area of the spinning rotor and of yarn withdrawal elements connected thereto;

FIG. 2 is a detailed view of FIG. 1 in the direction of the arrow II; and FIGS. 3 to 8 are partial sectional views of modified embodiments in which, in each case, downstream from a yarn withdrawal nozzle at least two deflections are formed with false-twisting edges for the yarn.

DETAILED DESCRIPTION OF THE DRAWINGS

Figure 5:
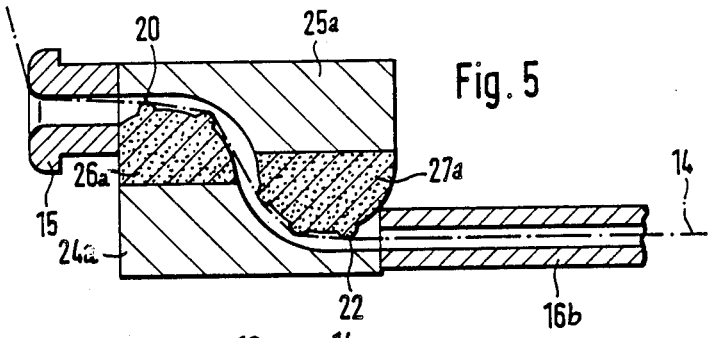

The open-end rotor spinning arrangement shown in FIG. 1 in a cutout contains a spinning rotor 1, the rotor plate 2 of which rotates in a vacuum chamber 3 that is formed by a rotor housing 4. The shaft 5 on which the rotor plate of the spinning rotor 1 is arranged is led through a bore 6 of the rear wall of the rotor housing 4 and is disposed and driven outside this rotor housing 4 in a way that is not shown in detail. The rotor housing 4 is connected to a vacuum source that is not shown, via a vaccum line 7.

The open front side of the rotor plate 2 and the rotor housing 4 are covered by a covering 8 that can be moved away. Between the rotor housing 4 and the covering 8, a surrounding seal 9 is provided. The covering 8 is provided with a projection 10 that projects into the interior of the rotor plate 2 and that contains a fiber feeding duct 11. The fiber feeding duct 11, in a way that is not shown, is connected with a feeding and opening device to which a sliver to be spun is fed. In the opening device, the sliver is opened up into individual fibers that are fed to the rotor plate 2, via the fiber feeding duct. Via the fiber feeding duct 11, the fibers are fed to a conical slide wall 12 of the rotor plate 2 that expands into a fiber collecting groove 13 and on which the fibers slide into the fiber collecting groove 13. The fibers collected as yarn 14 in the fiber collecting groove 13, first, are withdrawn essentially radially with respect to the fiber collecting groove, and are then deflected in a yarn withdrawal nozzle 15 arranged coaxially to the spinning rotor so that the yarn is withdrawn in axial direction of the spinning rotor 1. The yarn withdrawal takes place via a pair of yarn withdrawal rollers 17, in the direction of the arrow A. Subsequently, the yarn 14 is fed to a wind-up device that is not shown.

The yarn section between the yarn withdrawal nozzle 15 and the fiber collecting groove 13 rotates around the yarn withdrawal nozzle 15, in a crank-type way with the rotor plate 2, whereby the yarn in the area downstream from the yarn withdrawal nozzle 15 receives a true twist. In addition, the yarn 14 moves along the deflecting area of the yarn withdrawal nozzle 15, whereby the yarn, especially the section between the yarn withdrawal nozzle 15 and the fiber collecting groove 13, receives a false twist that has the same direction as the true yarn twist. In order to obtain a proportion of true yarn twist that is as large as possible in the section between the yarn withdrawal nozzle 15 and the fiber collecting groove 13, the following measures are provided.

In the embodiment according to FIG. 1, two deflections are provided in the yarn moving path directly downstream from the yarn withdrawal nozzle 15. The first one deflects the yarn 14 by approximately 60 degrees out of the path that is coaxial to the rotor plate 2. This deflection is formed by three ribs of an insertion piece 19 that are developed as false-twisting edges 20. The three false-twisting edges 20 have an approximately semicylindrically rounded cross-section and are applied diagonally to the moving direction of the yarn (FIG. 2). The angle of slope of the false-twisting edges 20 with respect to the moving direction of the yarn corresponds at least approximately to the direction of the slope of the yarn twist of the spun yarn 14; i.e., the false-twisting edges 20 shown in FIGS. 1 and 2 are suitable for Z-turned yarn 14. The insert 19 is made of ceramics preferably and is held in a support part 18. A yarn withdrawal tube 16 that is aimed in a straight line toward the pair of withdrawal rollers 17 is inserted into the support part 18. The front edge of the yarn withdrawal tube 16 that faces the yarn withdrawal nozzle 15 forms the second deflection 22. The second deflection 22 is staggered from the last false-twisting edge 20 of the insert 19 in yarn withdrawal direction A, such that the yarn 14 is guided at both deflecting points, i.e., the last false-twisting edge 20 and the end of the yarn withdrawal tube that forms the deflection 22. As shown in FIG. 2, the end of the yarn withdrawal tube 16 facing the yarn withdrawal nozzle 15 is also developed as a false-twisting edge; i.e., it is applied, at least in the area in which the yarn 14 moves against it, against the yarn with a slope that corresponds approximately to the slope of the yarn twist. Therefore, the yarn 14 is guided by the false-twisting edges 20, 22 on two sides that are opposite one another by 180 degrees.

In the embodiment according to FIG. 3, a yarn withdrawal channel connects to the yarn withdrawal nozzle 15 in yarn withdrawal direction. The yarn withdrawal channel is formed of two sections 23, **16*a* that are staggered with respect to one another. In this embodiment, the rear section is a yarn withdrawal tube 16*a* extending in a straight line. Between the two sections 23, 16*a*, a sleeve-shaped insert 31 is arranged, which includes a front edge and a rear edge both developed as false-twisting edges 20, 22. The edges provide yarn twist corresponding to the explanations of the embodiment according to FIGS. 1 and 2 discussed above. The insert 31** can be formed of a ceramic component that is sintered and pressed into this shape.

In the embodiment according to FIG. 4, a yarn withdrawal nozzle 15 and a yarn withdrawal tube **16*b* form sections of a yarn withdrawal channel that are staggered with respect to one another. Between the yarn withdrawal nozzle 15 and the yarn withdrawal tube 16*b*, two inserts 26, 27 are arranged which are held by supports 24, 25. These inserts 26, 27, that are preferably made of a ceramic material, form an approximately S-shaped path for the yarn 14. The two inserts 26, 27 are provided with false-twisting edges 20, 22 forming the deflections that rest against the yarn 14 on sides that are opposite one another. As shown in FIG. 4, the false-twisting edges 20, 22** form relatively flat deflecting angles.

The embodiment according to FIG. 5 corresponds essentially to the embodiment according to FIG. 4. However, the yarn withdrawal nozzle 15 and the yarn withdrawal tube 16*b* are staggered with respect to one another by a larger amount so that the inserts 26*a*, 27*a* that are held by supports 24*a*, 25*a* form deflections with larger deflecting angles. Also in this embodiment, false-twisting edges 20, 22 disposed at the inserts 26*a*, 27*a* are applied against the yarn and correspond to the slope of the yarn twist. Also in this embodiment, the withdrawn yarn is exposed to the false-twisting edges 20, 22 on two sides that are opposite one another.

Figure 6:
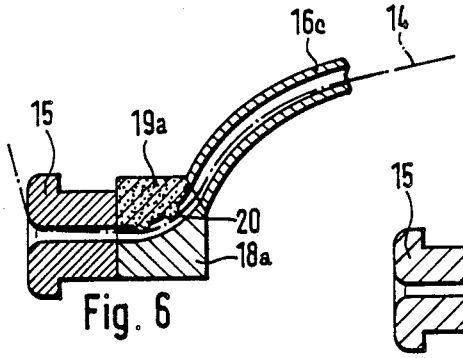

The embodiment according to FIG. 6, in principle, corresponds to the embodiment according to FIGS. 1 and 2. However, the yarn withdrawal tube 16*c* connected to the insert 19*a* and the support 18*a* is bent, and thus forms a deflecting point. In this embodiment, the second deflection in yarn withdrawal direction is not formed by a false-twisting edge. However, in this embodiment, the withdrawn yarn 14 is also guided on two sides that are opposite one another by 180 degrees.

Figure 7:
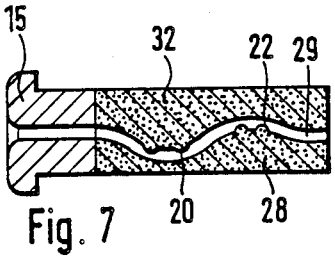

In the embodiment according to FIG. 7, two inserts 28, 32, that are preferably made of ceramics, are placed downstream from the yarn withdrawal nozzle 15. The inserts 28, 32 form a sinusoidal duct 29 between each other. In the area of the turning points of the sinusoidal duct 29, the inserts 32, 28 are provided with ribs that form false-twisting edges 20, 22. These edges 20, 22 are sloped toward the yarn withdrawal direction and correspond to the slope of the yarn twist. Also in this embodiment, the yarn is subjected to the effect of the false-twisting edges 20, 22 on two sides that are opposite one another.

Figure 8:
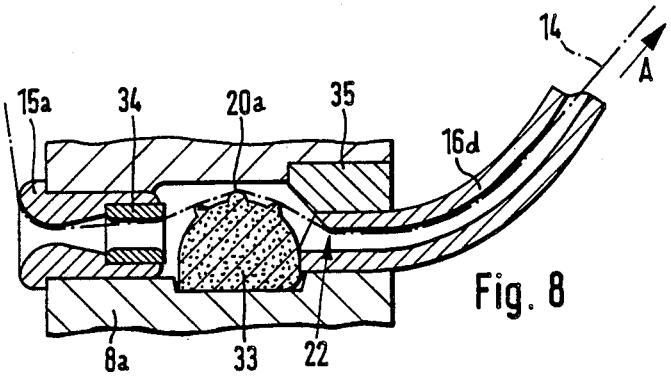

In the embodiment according to FIG. 8, a yarn withdrawal nozzle 15*a*, which includes an inserted guiding part 34, and a bent yarn withdrawal tube 16*d* downstream from the nozzles form two sections of a yarn withdrawal duct that are arranged in a straight line. Between these two sections, an insert 33 is arranged that has an approximately semicylindrical shape and that is provided with three false-twisting edges 20*a*. The insert 33 is dimensioned in such a way that the false-twisting edges 20*a* deflect the moving yarn 14 with respect to the two sections 34, 16 of the duct such that three deflections are present. There is one deflection at the end of the guiding part 34, one deflection in the area of the false-twisting edges 20*a* of the insert 33 and one deflection in the area of the start of the yarn withdrawal tube 16*d*.

As a modification of the shown embodiment, the deflections formed by the guiding part 34 and by the yarn withdrawal tube 16*d* adjacent to the insert 33 are developed as false twisting edges; i.e., they are correspondingly sloped with respect to the yarn withdrawal device and correspond to the yarn twist.

The insert 33 of the embodiment according to FIG. 8 is inserted into a recess of the covering 8*a* of the rotor housing 4 and is held there with the edge of the yarn withdrawal pipe 16*d*. The yarn withdrawal pipe 16*d* is secured in the covering 8*a* by a transition piece 35. By the use of inserts 33 of different diameters and/or by the placing of small spacer plates underneath the inserts 33, the deflection of the yarn moving path can be adjusted. In a preferred embodiment of the invention, the insert 33 can be held detachably in place as an exchangable part, so that an adjustment of the deflection of the yarn moving path can be made by simply replacing the insert 33 with a different type insert, for example with an insert having a different diameter.

As discussed above with respect to the insert 33 of the embodiment according to FIG. 8, the novel inserts of all embodiments contemplated by this invention, can be constructed as exchangeable parts detachably held on the machine, for example on the yarn withdrawal nozzle or the yarn withdrawal tube. This novel detachable feature will allow replacement of these inserts in case of wear of the deflections and/or the false-twisting edges or also when changing over to adjust the deflection of the yarn moving path.

The term "false-twisting edges" is always used to define ribs that with respect to the moving direction of the yarn are sloped by an angle of slope that corresponds at least approximately to the slope of the yarn twist of the spun yarn. Deflecting edges become "false-twisting edges" in the sense of the invention only if they meet the above-mentioned requirement.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Apparatus for open-end spinning comprising:

twisting means for twisting yarn;

yarn withdrawal nozzle means downstream from said twisting means in a yarn withdrawal direction;

yarn withdrawal means downstream from said yarn withdrawal nozzle means for withdrawing yarn from said twisting means;

yarn deflection means for deflecting yarn downstream from said yarn withdrawal nozzle means, said yarn deflection means including at least one false twisting edge, said yarn deflection means including a first deflection continuously guiding and deflecting the yarn in a first direction and at least one additional deflection downstream from said first deflection, said at least one additional deflection continuously guiding and deflecting the yarn into a direction deviating from the first direction;

at least one yarn withdrawal insert downstream from said yarn withdrawal nozzle means, said first deflection being disposed in said at least one yarn withdrawal insert; and a downstream yarn withdrawal duct downstream from said insert, said at least one additional deflection being disposed in one of said yarn withdrawal insert and said yarn withdrawal duct.

2. Apparatus as in claim 1, wherein the first deflection and at least one additional deflection are disposed on opposite sides of the yarn.

3. Apparatus as in claim 1, wherein the first deflection has at least one false-twisting edge.

4. Apparatus as in claim 3, wherein the at least one additional deflection has at least one false-twisting edge.

5. Apparatus as in claim 4, wherein said false-twisting edges include ribs that with respect to the moving direction of the yarn are sloped by an angle of slope that corresponds at least approximately to a slope of yarn twist of a spun yarn.

6. Apparatus as in claim 1, wherein the at least one additional deflection has at least one false-twisting edge.

7. Apparatus as in claim 1, wherein said downstream yarn withdrawal duct includes at least one additional deflection.

8. Apparatus as in claim 7, wherein said downstream yarn withdrawal duct includes an end facing said insert being formed as at least one of an additional deflection and a false-twisting edge.

9. Apparatus as in claim 1, further including an upstream yarn withdrawal duct upstream from said yarn withdrawal insert, said at least one insert being inserted between said upstream yarn withdrawal duct and said downstream yarn withdrawal duct.

10. Apparatus as in claim 9, wherein said downstream yarn withdrawal duct includes an end facing the insert being formed as at least one of a deflecting edge and a false-twisting edge.

11. Apparatus as in claim 9, wherein said upstream withdrawal duct and said downstream withdrawal duct are staggered with respect to one another, said insert further including said at least one additional deflection.

12. Apparatus as in claim 1, wherein the insert is constructed as a sleeve, said sleeve having a first end facing the yarn withdrawal nozzle means being formed as a false-twisting edge forming the first deflection and a second end facing away from said yarn withdrawal nozzle means being formed as a false-twisting edge forming the second deflection.

13. Apparatus as in claim 9, wherein said insert includes at least one false-twisting edge.

14. Apparatus as in claim 13, wherein said upstream yarn withdrawal duct includes a preliminary deflection upstream from the first deflection and said downstream yarn withdrawal duct includes at least another additional deflection.

15. Apparatus as in claim 13, wherein said upstream yarn withdrawal duct is connected to said yarn withdrawal nozzle means.

16. Apparatus as in claim 9, wherein said upstream and downstream yarn withdrawal ducts are staggered with respect to one another and connect to the yarn withdrawal nozzle, and further including a plurality of inserts disposed between said upstream and downstream ducts, said inserts including false-twisting edges, said inserts forming an approximately S-shaped path for yarn withdrawal, said upstream and downstream ducts each connecting approximately tangentially to said inserts.

17. Apparatus as in claim 9, wherein said upstream and downstream yarn withdrawal ducts are staggered with respect to one another, and further including a plurality of inserts disposed adjacent one another in the yarn withdrawal direction between said upstream and downstream ducts, said inserts each including false-twisting imges forming said deflections, said inserts forming a sinusoidal path for yarn withdrawal.

18. Apparatus as in claim 17, wherein said plurality of inserts include a first insert and a second insert downstream from said first insert, said first and second inserts forming an S-shaped path for yarn withdrawal.

19. Apparatus as in claim 18, wherein said upstream yarn withdrawal duct connects to the yarn withdrawal nozzle means, and said upstream yarn withdrawal duct and said downstream yarn withdrawal duct connect approximately tangentially to the first and second inserts.

20. Apparatus as in claim 1, wherein said insert is connected to said yarn withdrawal nozzle means, said insert forming an approximately sinusoidally extending duct, said sinusoidally extending duct including yarn turning points, each of said yarn turning points including at least one false-twisting edge.

21. Apparatus as in claim 1, wherein said yarn withdrawal duct is removably attached to said yarn withdrawal insert.

22. Apparatus for open-end spinning comprising:

twisting means for twisting yarn;

yarn withdrawal nozzle means downstream from said twisting means in a yarn withdrawal direction;

yarn withdrawal means downstream from said yarn withdrawal nozzle means for withdrawing yarn from said twisting means;

yarn deflection means for deflecting yarn downstream from said yarn withdrawal nozzle means, said yarn deflection means including at least one false twisting edge, said yarn deflection means including a first deflection continuously guiding and deflecting the yarn in a first direction and at least one additional deflection downstream from said first deflection, said at least one additional deflection continuously guiding and deflecting the yarn in a direction deviating from the first direction;

a yarn withdrawal duct, said yarn withdrawal duct including a first section and a second section, said second section being disposed downstream from said first section; and at least one insert being inserted between said first and second sections of the yarn withdrawal duct, said first deflection being disposed on said at least one insert.

23. Apparatus as in claim 22, wherein said second section includes and end facing the insert being formed as at least one of a deflecting edge and a false-twisting edge.

24. Apparatus as in claim 22, wherein said first section and said section are staggered with respect to one another, said insert further including said at least one additional deflection.

25. Apparatus as in claim 24, wherein the insert is constructed as a sleeve, said sleeve having a first end facing the yarn withdrawal nozzle means being formed as a false-twisting edge forming the first deflection and a second end facing away from said yarn withdrawal nozzle means being formed as a false-twisting edge forming the second deflection.

26. Apparatus as in claim 22, wherein said insert includes at least one false-twisting edge.

27. Apparatus as in claim 26, wherein the first section of the yarn withdrawal duct includes the first deflection, the insert includes at least one additional deflection, and the second section of the yarn withdrawal duct includes at least another additional deflection.

28. Apparatus as in claim 26, wherein the yarn withdrawal duct is connected to said yarn withdrawal nozzle means.

29. Apparatus as in claim 22, wherein the first and second sections of the yarn withdrawal ducts are staggered with respect to one another and connect to the yarn withdrawal nozzle, and further including a plurality of inserts disposed between said sections, said inserts including false-twisting edges, said inserts forming an approximately S-shaped path for yarn withdrawal, said sections of the yarn withdrawal duct each connecting approximately tangentially to said inserts.

30. Apparatus as in claim 22, wherein the first and second sections of the yarn withdrawal duct are staggered with respect to one another, and further including a plurality of inserts disposed adjacent one another in the yarn withdrawal direction, said inserts each including false-twisting edges forming said deflections, said inserts being disposed between said first and second section of the yarn withdrawal duct, said inserts forming a sinusoidal path for yarn withdrawal.

31. Apparatus as in claim 30, wherein said plurality of inserts include a first insert and a second insert downstream from said first insert, said first and second inserts forming an S-shaped path for yarn withdrawal.

32. Apparatus as in claim 31, wherein the yarn withdrawal duct connects to the yarn withdrawal nozzle means, and said first and second sections of the yarn withdrawal duct connect approximately tangentially to the first and second inserts.

33. Apparatus for an open-end spinning unit of the type having twisting means for twisting yarn, yarn withdrawal nozzle means downstream from said twisting means in a yarn withdrawal direction, and yarn withdrawal means downstream from said yarn withdrawal nozzle means for withdrawing yarn from said twisting means, said apparatus comprising:

inset means insertable downstream from said yarn withdrawal nozzle means, said insert means including yarn deflection means for deflecting yarn downstream from said yarn withdrawal nozzle means, said yarn deflection means including a first deflection including at least one false-twisting edge and continuously guiding and deflecting the yarn in a first direction and at least one additional deflection downstream from said first deflection, said at least one additional deflection including at least one false-twisting edge and continuously guiding and deflecting the yarn into a direction deviating from the first direction.

34. Apparatus for open-end spinning comprising:

twisting means for twisting yarn;

yarn withdrawal nozzle means downstream from said twisting means in a yarn withdrawal direction;

yarn withdrawal means downstream from said yarn withdrawal nozzle means for withdrawing yarn from said twisting means;

yarn deflection means for deflecting yarn downstream from said yarn withdrawal nozzle means, said yarn deflection means including at least one false twisting edge, said yarn deflection means including a first deflection continuously guiding and deflecting the yarn in a first direction and at least one additional deflection downstream from said first deflection, said at least one additional deflection continuously guiding and deflecting the yarn into a direction deviating from the first direction;

a yarn withdrawal insert downstream from said yarn withdrawal nozzle means, said first deflection being disposed in said yarn withdrawal insert; and a yarn withdrawal duct downstream from said yarn withdrawal insert, said yarn withdrawal duct including at least one additional deflection.

35. Apparatus as in claim 34, wherein said yarn withdrawal duct includes an end facing said insert being formed as at least one of an additional deflection and a false-twisting edge.

36. Apparatus for open-end spinning comprising;

twisting means for twisting yarn;

yarn withdrawal nozzle means downstream from said twisting means in a yarn withdrawal direction;

yarn withdrawal means downstream from said yarn withdrawal nozzle means for withdrawing yarn from said twisting means;

yarn deflection means for deflecting yarn downstream from said yarn withdrawal nozzle means, said yarn deflection means including at least one false twisting edge, said yarn deflection means including a first deflection continuously guiding and deflecting the yarn in a first direction and at least one adidtional deflection downstream from said first deflection, said at least one additional deflection continuously guiding and deflecting the yarn into a direction deviating from the first direction; and an insert connected to and downstream from said yarn withdrawal nozzle means, said insert forming an approximately sinusoidally extending duct, said sinusoidally extending duct including yarn turning points, each of said yarn turning points including at least one false-twisting edge.

37. Apparatus for open-end spinning comprising:

twisting means for twisting yarn;

yarn withdrawal nozzle means downstream from said twisting means in a yarn withdrawal direction;

yarn withdrawal means downstream from said yarn withdrawal nozzle means for withdrawing yarn from said twisting means;

yarn deflection means for deflecting yarn downstream from said yarn withdrawal nozzle means, said yarn deflection means including at least one false twisting edge, said yarn deflection means including a first deflection continuously guiding and deflecting the yarn in a first direction and at least one additional deflection downstream from said first deflection, said at least one additional deflection continuously guiding and deflecting the yarn into a direction deviating from the first direction; and a yarn withdrawal insert downstream from said yarn withdrawal nozzle means, said first deflection being disposed in said yarn withdrawal insert, and said at least one additional deflection being disposed downstream from said yarn withdrawal insert.

* * * * *